US005671975A

United States Patent [19]

Müller

[11] Patent Number: 5,671,975

[45] Date of Patent: Sep. 30, 1997

[54] SEATING SYSTEM WITH HORIZONTAL BAR HAVING SEAT PORTIONS CONNECTED THERETO

[75] Inventor: Anton Müller, Aalen, Germany

[73] Assignee: Eisen- und Drahtwerk Erlau Aktiengesellschaft, Aalen, Germany

[21] Appl. No.: 634,800

[22] Filed: Apr. 19, 1996

[30] Foreign Application Priority Data

Apr. 19, 1995 [DE] Germany ..... 29506593 U

[51] Int. Cl.[6] ..... A47C 7/00

[52] U.S. Cl. ..... 297/445.1; 297/452.64; 297/452.18; 297/232

[58] Field of Search ..... 297/232, 452.18, 297/452.64, 452.3, 445.1; 248/188.1, 188.7

[56] References Cited

U.S. PATENT DOCUMENTS

| | | | |
|---|---|---|---|
| 2,944,589 | 7/1960 | Balfour | 297/232 |
| 3,316,013 | 4/1967 | Abel et al. | 297/232 |
| 3,767,261 | 10/1973 | Rowland | 297/452.64 |
| 3,885,766 | 5/1975 | Resch et al. | 248/188.1 |
| 3,893,729 | 7/1975 | Sherman et al. | 297/232 X |
| 4,099,780 | 7/1978 | Schmidhuber | 297/232 X |
| 4,229,040 | 10/1980 | Howell et al. | 297/232 X |
| 5,558,309 | 9/1996 | Marechal | 297/232 X |

FOREIGN PATENT DOCUMENTS

| | | |
|---|---|---|
| 0065644 | 12/1982 | Denmark . |
| WO 95/09742 | 4/1995 | United Kingdom . |

*Primary Examiner*—Peter M. Cuomo
*Assistant Examiner*—Stephen Vu
*Attorney, Agent, or Firm*—Robert W. Becker & Associates

[57] ABSTRACT

A seating system has at least one support and at least one horizontal bar supported by the at least one support. At least one seat portion is connected to the horizontal bar. The at least one support has at least one suspending member. At least one support arm is provided for each support. The at least one support arm is hung from the at least one support. The support arm connects the horizontal bar to the support.

52 Claims, 18 Drawing Sheets

SEATING SYSTEM WITH HORIZONTAL BAR HAVING SEAT PORTIONS CONNECTED THERETO

BACKGROUND OF THE INVENTION

The present invention relates to a seating system with at least one horizontal bar supported on at least one support and having connected thereto at least one seat portion.

In this known seating system at the two ends of the horizontal bar a support is respectively connected. Over the length of the horizontal bar seat portions are mounted.

Further seating systems are known in which over the length of the horizontal bar a plurality of supports are provided with which the seating system is supported on the ground, respectively, with which it is anchored in the ground.

In these seating systems the supports are either welded to the horizontal beam or connected thereto with clamping means. The mounting of such seating systems is thus cumbersome and expensive.

It is therefor an object of the present invention to embody a seating system of the aforementioned kind such that is of a constructively simple embodiment and can be effortlessly and quickly mounted.

SUMMARY OF THE INVENTION

The seating system according to the present invention is primarily characterized by:

at least one support;

at least one horizontal bar supported by the at least one support;

at least one seat portion connected to the horizontal bar;

the least one support comprising at least one suspending member;

at least one support arm for each one of the at least one support;

the at least one support arm hung from the at least one support; and the at least one support arm connecting the horizontal bar to the at least one support.

Preferably, the at least one support arm is clamped to the at least one suspending member.

Advantageously, the at least one suspending member has at least one clamping member for clamping the at least one support arm.

Preferably, the at least one clamping member has at least one receiving element for the at least one support arm.

In another embodiment of the present invention, the at least one receiving element is a groove in the clamping member.

The groove is preferably an annular groove.

Advantageously, the clamping member comprises a first base body and a first disk connected to the end face of the base body.

Advantageously, the first disk has a plate body and an outer edge bent at a right angle to the plate body.

In another embodiment of the present invention, the outer edge together with the base body forms the receiving element.

Preferably, the suspending member has a second base body positioned opposite the first base body.

Preferably, the second base body comprises a second disk connected to an end face of the second base body.

Advantageously, the second disk has a second plate body and an outer edge bent at a right angle to the second plate body.

Expediently, the first and second base bodies are identical and positioned mirror-symmetrical to one another.

In yet another embodiment of the present invention, the first and second base bodies are positioned coaxially to one another.

Preferably, at least one of the first and second base bodies has the shape of a truncated cone.

Preferably, the at least one of the first and second base bodies tapers in a direction away from the disks connected thereto.

Expediently, the first disk has a greater diameter than the first base body and the second disk has a greater diameter than the second base body.

Advantageously, the at least one support has at least one middle section and the at least one suspending member is positioned at the at least middle section.

Advantageously, the middle section is cylindrical.

Preferably, the at least one support further comprises a ring surrounding the middle section.

The ring has a smaller axial length than the middle section.

Preferably, each one of the supports comprises two suspending members connected to opposite end faces of the middle section.

Preferably, the at least one support comprises at least one leg connected to the lower one of the suspending members.

Advantageously, the at least one leg and the at least one support arm are identical.

Preferably, the at least one support arm comprises a first end piece with projections and the projections engage the receiving element.

In another embodiment of the present invention, the first end piece has an end face facing the base body, wherein the end face matches the contour of the base body and rests flush at the base body.

Advantageously, the support arm is positioned on edge.

The at least one support arm comprises a second end piece for engaging the horizontal bar.

The second end piece is preferably clamped at the horizontal bar.

The at least one support arm has expediently a center piece extending angularly to the first and the second end pieces.

Advantageously, the at least one seat portion has a triangular cross-section.

Advantageously, the seat portion comprises lateral frame portions and a wire mesh, the wire mesh connected to the lateral frame portions.

Preferably, each one of the frame portions in cross-section is U-shaped with a first and a second leg. The first leg to which the wire mesh is connected is preferably longer than the second leg.

The seat portion may also be a shelf or table providing a means on which to place bags, luggage, drinks, food, etc.

Preferably, the seating system further comprises at least one backrest connected to the horizontal bar.

The backrest and the seat portion are preferably identical.

In another embodiment of the present invention, the seating system further comprises at least one first support beam for connecting the seat portion to the horizontal bar.

Preferably, the seat portion has a bearing member and the at least one support beam has a first end with a bearing cup for receiving the bearing member.

Advantageously, the seating system further comprises a clamping piece connected to the at least one support beam for fastening the bearing member within the bearing cup.

The at least one first support beam has a second end with a second bearing cup for attaching the at least one support beam to the horizontal bar.

Advantageously, the seating system further comprises at least one second support beam for connecting the backrest to the horizontal bar.

The first and second support beams are preferably connected so as to be pivotable to one another.

Advantageously, the first and second support beams are identical.

The first and second support beams enclose the horizontal bar and are clamped to the horizontal bar.

The at least one horizontal bar comprises a means for securing the first and second support beams against rotation.

Preferably, the means for securing is at least one flattened portion of the at least one horizontal bar.

Advantageously, the first and second support beams have a flattened portion for matching the flattened portion of the at least one horizontal bar.

In another embodiment of the present invention the at least one support is positioned adjacent to the horizontal bar.

The seating system in a preferred embodiment of the present invention may comprise at least two horizontal bars, wherein one of the at least one supports is a central support for the at least two horizontal bars.

Each one of the horizontal bars is connected with one of the support arms to the at least one suspending member of the central support.

In a preferred embodiment of the present invention the at least one horizontal bar has a round cross-section.

In the inventive seating system the horizontal bar with the seat portion or seat portions connected thereto is suspended via the support arm in the suspending member of the support. Accordingly, the inventive seating system can be effortlessly and simply mounted.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
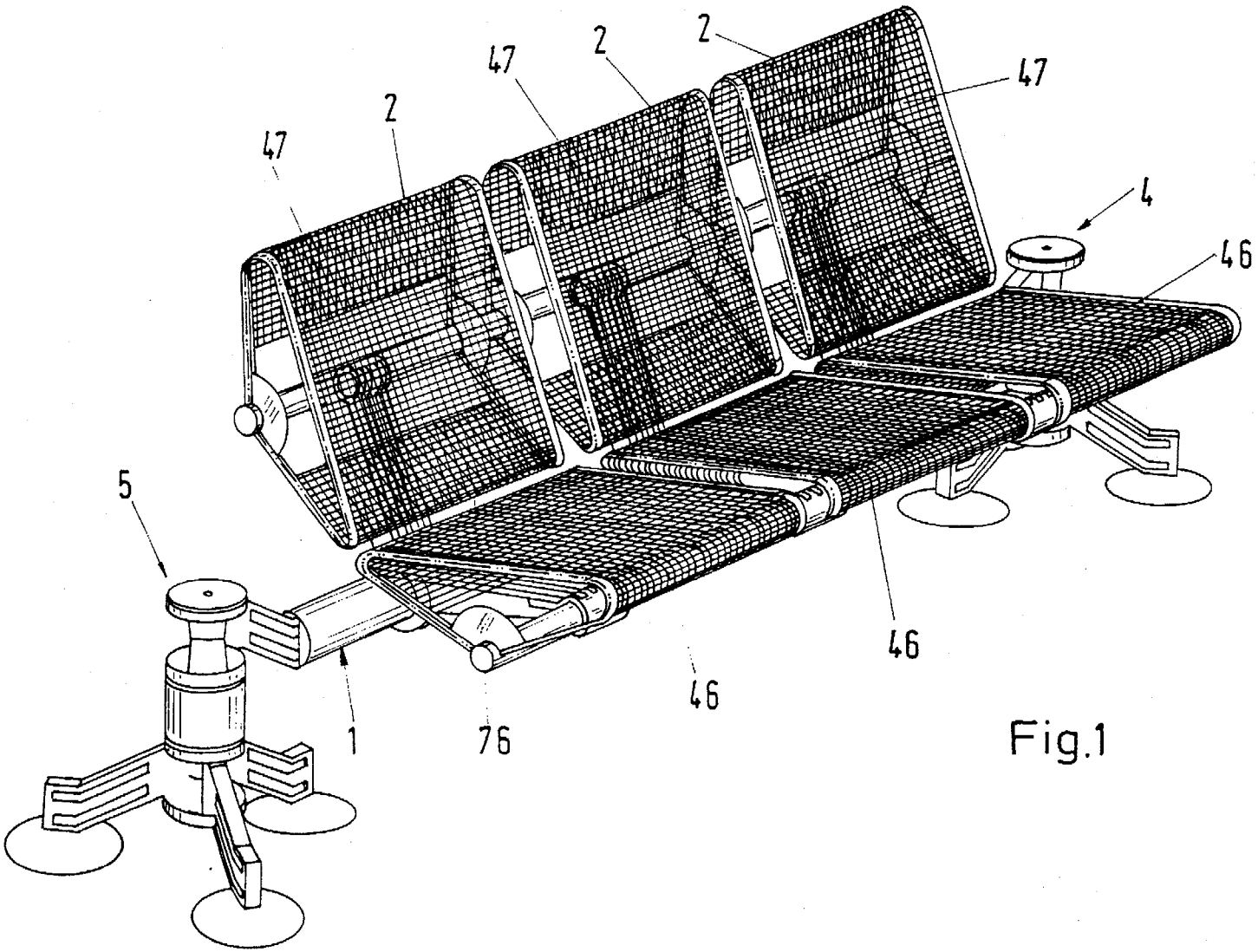
FIG. 1 shows a perspective representation of the inventive seating system.
Figure 2:
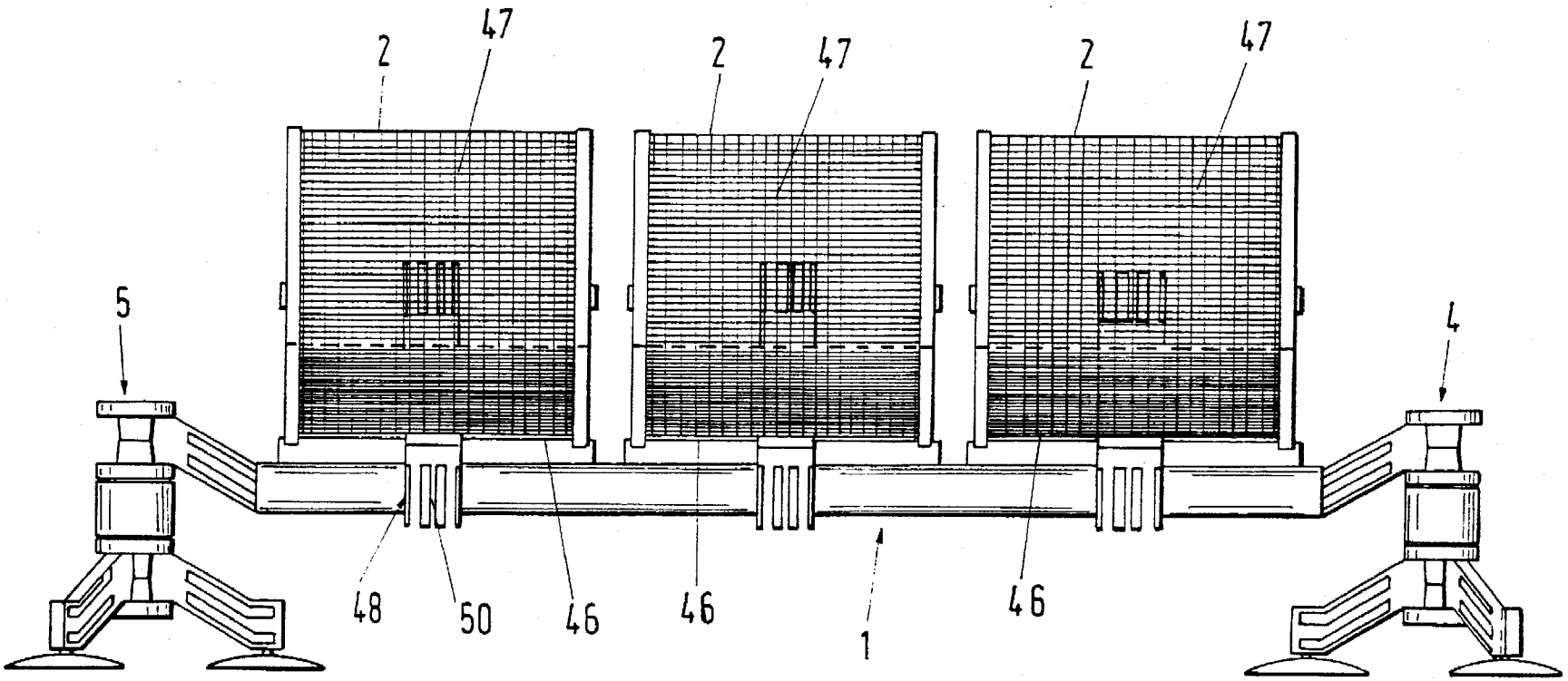
FIG. 2 shows a front view of the seating system according to FIG. 1.
Figure 5:
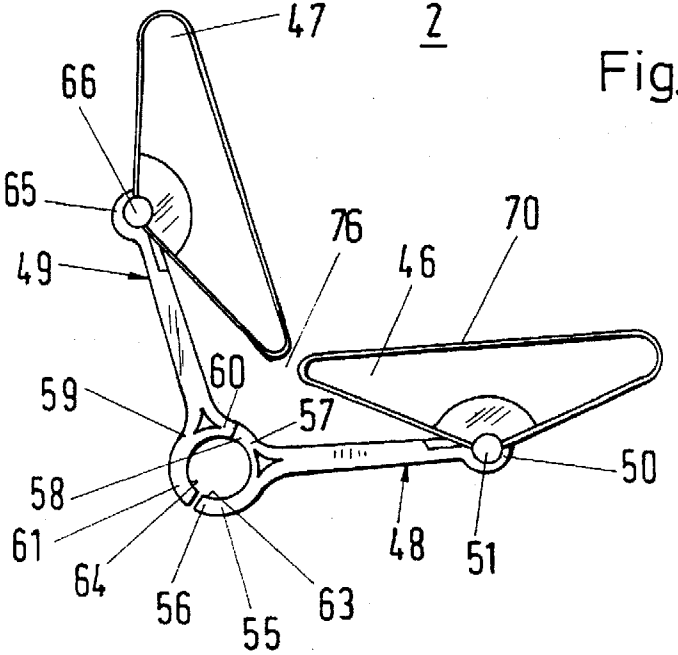
FIG. 5 shows a side view of the seat according to FIG. 3.
Figure 4:
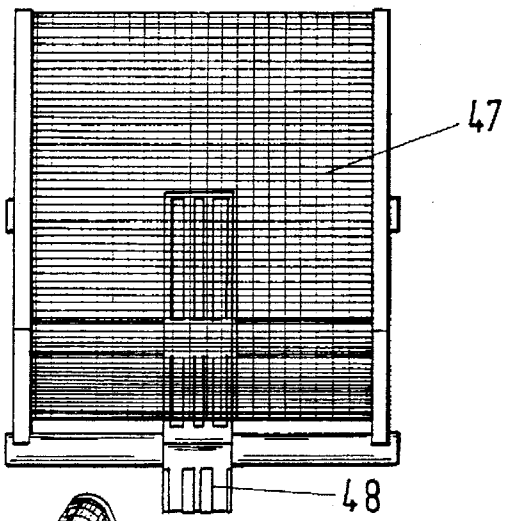
FIG. 4 shows a front view of the seat of FIG. 3.
Figure 3:
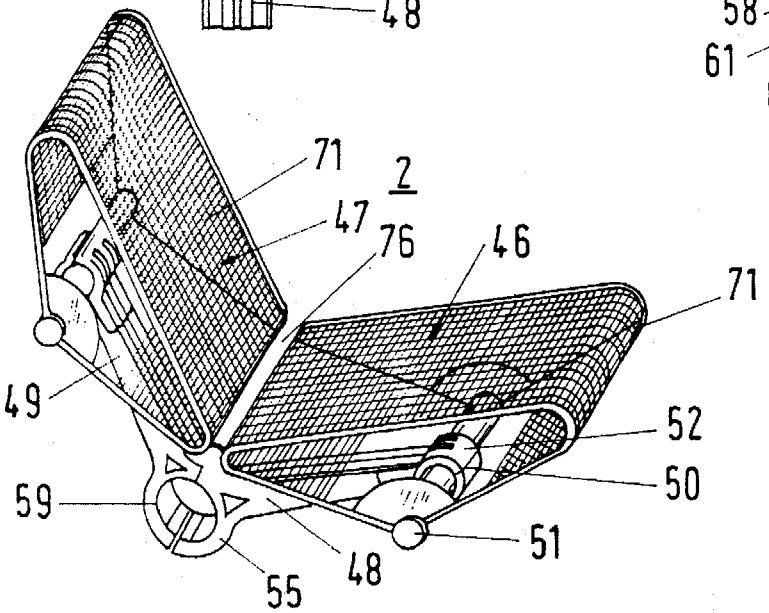
FIG. 3 shows a seat of the inventive seating system in a perspective representation.

The present invention will now be described in detail with the aid of several specific embodiments utilizing FIGS. 1 through 23.

The seating system according to the present invention can be used outdoors, but also, for example, in waiting areas of train stations, airports etc. The support structure 1, which will be explained in the following in more detail with the aid of FIGS. 9 through 13, comprises in the embodiment of FIG. 1 three seats 2 arranged adjacent to one another. Depending on the length of the support structure 1, one or more seats can be provided. The support structure 1 may be so short that only one seat 2 is connected thereto.

The seats 2 have a seat portion and a backrest. It is also possible to design the seats 2 such that only a seat portion but no backrest is provided. It is also possible to combine at the support structure 1 seats with backrests and seats without backrest. For example, seats 2 with backrests and seats without backrests can be arranged alternatingly along the length of the support structure 1. The seats without backrest can then be used as a table or shelf, for example, in order to place suitcases, bags etc. on the seat portion.

The support structure 1 has a horizontal bar 3 (FIGS. 9, 10, and 12), the length of which is determined by the number of seats to be connected thereto. The horizontal bar 3 is made of a tubular material that has preferably a circular cross-section. The horizontal bar 3 is supported by two supports 4 and 5 which are detachably connected to the horizontal bar 3. Since the two supports 4, 5 are of identical design, in the following only the support 4 will be explained in detail.

Figure 8:
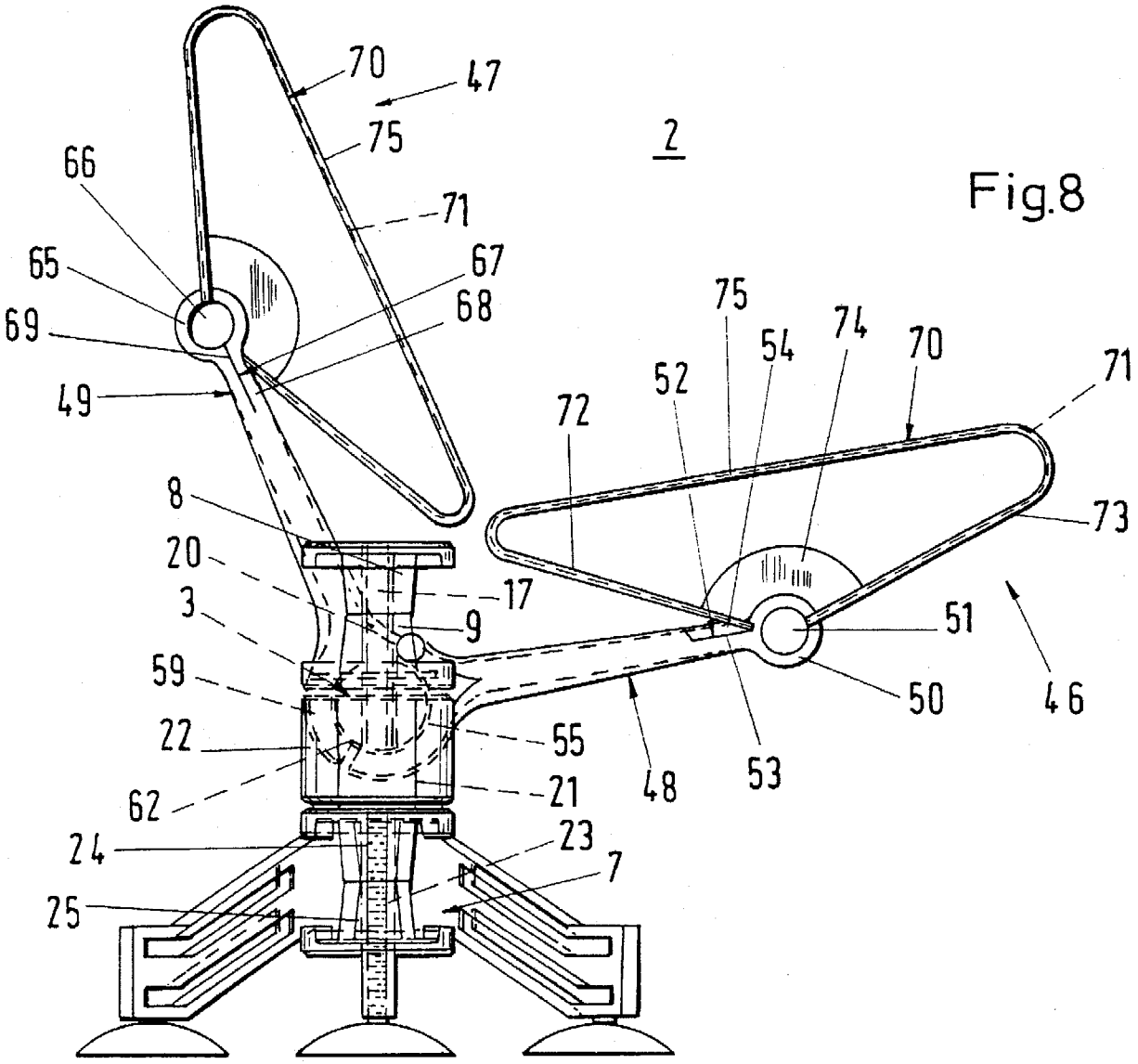
FIG. 8 is an enlarged representation of a side view of the seating system of FIG. 6.
Figure 9:
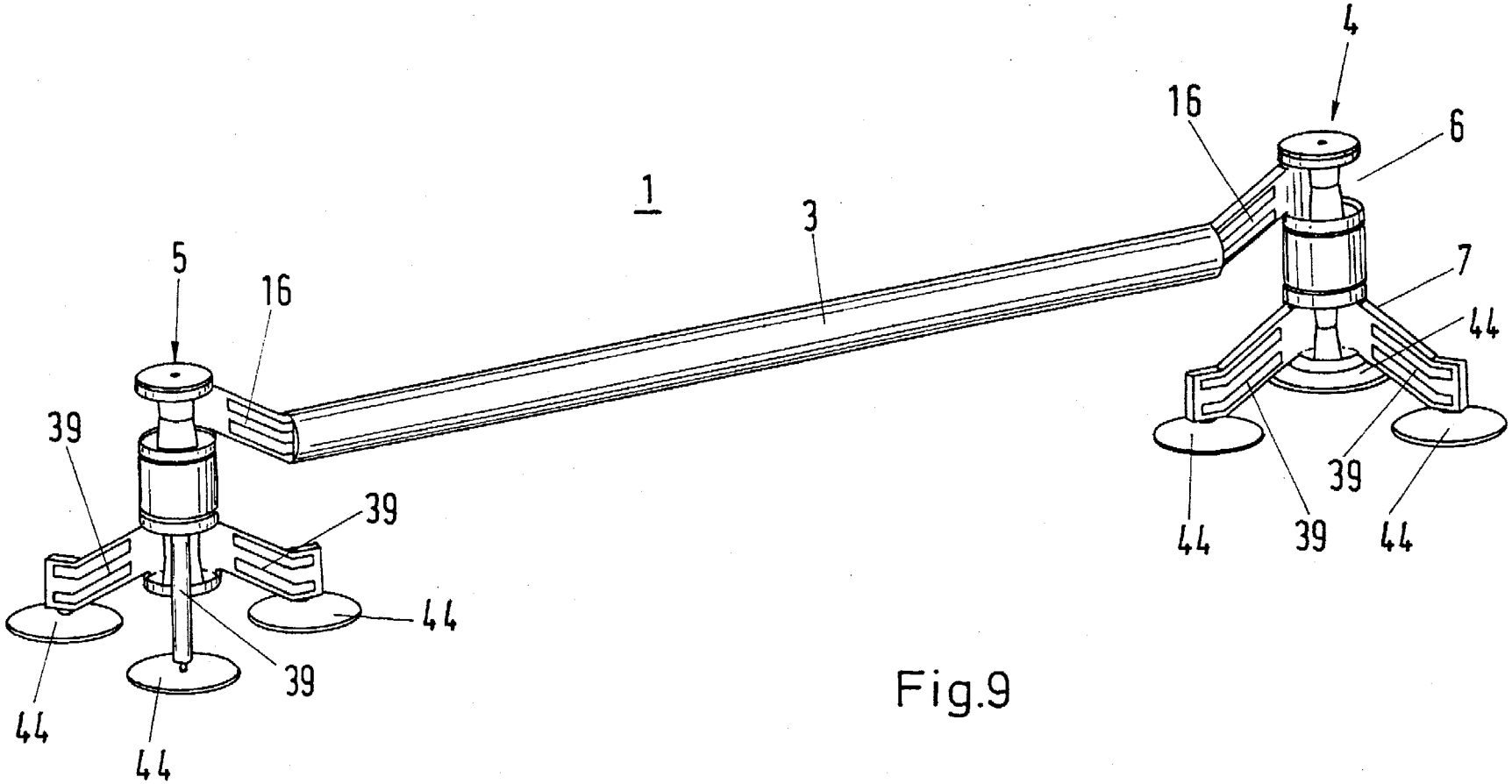
FIG. 9 shows in a perspective representation the support structure of the inventive seating systems.
Figure 11:
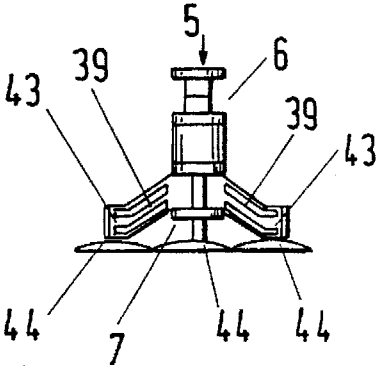
FIG. 11 shows a side view of the support structure of FIG. 10.
Figure 10:
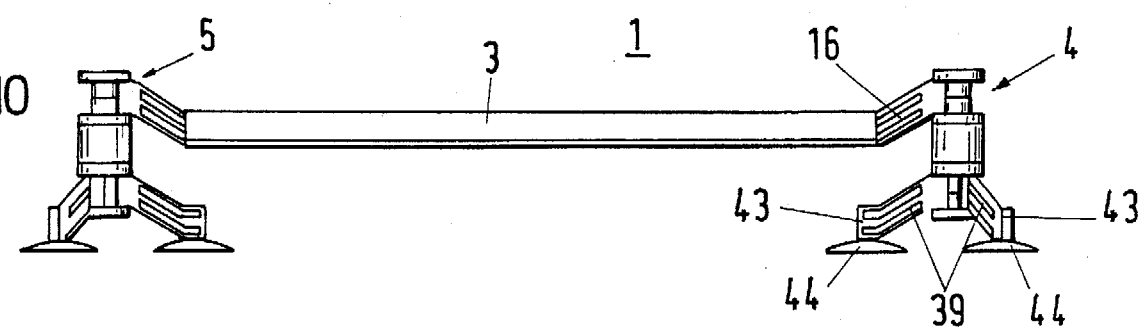
FIG. 10 shows a front view of the support structure of FIG. 9.

The support 4 has two suspending members 6 and 7 which are arranged in alignment with one another atop another and which are essentially identical. The upper suspending member (FIG. 13) has two base bodies 8 and 9 of a truncated cone shape whereby their planar end faces are facing one another. The end faces which face away from one another are provided respectively with a disk 10 and 11 having edges 12, 13 that extend at a right angle relative to the plate body of the disks 10 and 11. The two disks 10, 11 have the same diameter. The outer edges 12, 13 are bent so as to point toward one another. Due to the bent outer edges 12, 13 of each disk 10, 11 annular suspending grooves 14 and 15 are provided from which the support arm 16 can be suspended or hung. The two base bodies 8 and 9 are clamped relative to one another by threaded bolts 17 (FIG. 8). For this purpose, the base bodies 8, 9 are provided with corresponding axially and centrally arranged throughbores 18 and 19

(FIG. 13) through which the threaded bolt 19 extends. The threaded bolt is threaded into a threaded bore 20 of the middle section 21 (FIG. 8 and 13) having a circular cross-section and being surrounded by a ring 22. The middle section 21 has advantageously the same outer dimensions as the disks 10, 11 of the base bodies 8, 9. The ring 22 is axially slightly shorter than the middle section 21 at which the end faces of the base bodies 8, 9 rest with their disks 10, 11.

Figure 13:
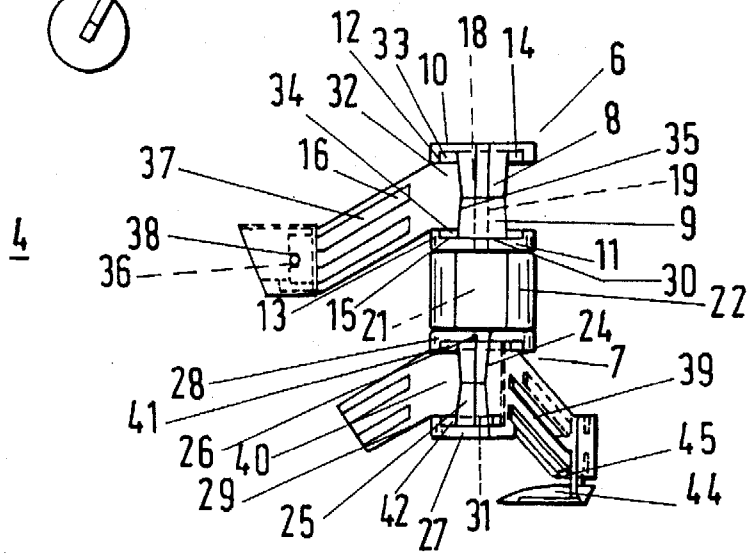
FIG. 13 shows in an enlarged representation a lateral support of the support structure of FIG. 10.

A threaded bolt 23 (FIG. 8) is threaded into the middle section 21 from below with which the two base bodies 24 and 25 of the lower suspending member 7 are fastened at the middle section 21. The base bodies 24, 25 are of identical design as the base bodies 8, 9 of the upper suspending member 6 and also have the shape of a truncated cone. The base bodies 24, 25 are positioned with their end faces so as to abut one another. The end faces facing away from one another are provided with disks 26 and 27. The two disks 26, 27 are identical to the disks 10, 11 and have an outer edge 28, 29 which is bent at a right angle relative to the plate bodies of the disks 26, 27. The edges 28, 29 are bent so as to point toward one another and delimit together with the base bodies 24, 25 of a truncated cone shape the annular suspending groove 30, 31 (FIG. 13).

The base bodies 8, 9; 24, 25 are clamped relative to one another and relative to the middle section 21 with threaded bolts 17, 23 when these bolts 17, 23 are threaded into the threaded bores of the middle section 21. The base bodies 9 and 24 are supported with the respective disks 11, 26 at the end faces of the middle section 21 which slightly projects in the axial direction past the ring 22. Since the base bodies 8, 9; 24, 25 are advantageously of identical design, an especially simple and inexpensive manufacture of these parts is possible. As an alternative to the described embodiment, it is also possible to provide the base bodies 8 and 25 with corresponding axially projecting threaded portions which would be inserted through corresponding through openings of the respective other base body 9 and 24 and would thus be threaded into the middle section 21. In this manner a reliable mounting of the supports 4 and 5 can also be achieved.

The support arm 16 is of a flat construction and has an end piece 32 at the end facing the support which is provided with two oppositely pointing noses (projections) 33 and 34 projecting in the upward and downward direction. The noses 33, 34 engage in a positive-locking manner the suspending grooves 14 and 15 of the suspending member 6 (FIG. 13). The end face 35 of the end piece 32, in a side view according to FIG. 13, is V-shaped so that the end piece 32 rests flush at the mantle surface of the two base bodies 8, 9. Due to this V-shaped embodiment of the end face 35 it is ensured that the end piece 32 of the support arm 16 is securely clamped between the two disks 10 and 11 of the suspending member 6 in the axial as well as radial direction. Since the base bodies 8, 9 of the suspending member 6 have a truncated cone shape, a reliable clamping of the end piece 32 within the suspending member 6 is ensured when tightening the threaded bolt and clamping the two base bodies 8 and 9 relative to one another. The dimensions of the base bodies 8, 9 are selected such that they do not rest with their end faces on one another when the support arm 16 is mounted but have a minimal distance relative to one another. The support arm 16 is thus securely clamped within the suspending member 6.

It is, however, also possible to design the base bodies 8, 9 to be cylindrical so that the end face 35 of the end piece 32 in this embodiment extends straight. The clamping of the end piece 32 within the suspending member 6 is then achieved exclusively via the disks 10, 11 of the base bodies 8, 9 which cooperate with the projections 33, 34 of the support arm 16. The bent outer edges 12, 13 of the disks 10, 11 prevent that the support arm 16 can be released radially from the suspending member 6.

The support arm 16 extends at an oblique angle in a downward direction from the end piece 32 and has a second end piece 36 with which the support arm 16 engages one end of the horizontal bar 3.

The support arm 16 over its entire length has a constant width. In the area between the end pieces 32 and 36 it is provided on both longitudinal sides with at least one depression 37 which extends in the longitudinal direction of the support arm into the area of the end piece 36. In the area of the end piece 36 the depression 37 is angled at an oblique angle. In the shown embodiment the two depressions extend parallel to one another. Their depth decreases from the end piece 36 in the direction toward the other end of the depression in a continues manner. Of course, these supports arms 16 can also be embodied so as to be continuously planar at their longitudinal sides.

The end piece 36 within the horizontal bar 3 is positioned between two non-represented clamping parts between which the end piece 36 is clamped with clamping screw 38 (FIG. 13). It is supported in the wall of the horizontal bar 3 and presses one clamping piece against the end piece 36 of the support arm 16 which itself is pressed against the clamping piece. At least this other clamping piece matches the inner shape of the horizontal bar 3 so that it is forced tightly against the inner wall of the horizontal bar 3 under the clamping pressure fixedly. Of course, any other suitable fastening of the end piece 36 at the horizontal bar 3 is possible.

With the lower suspending member 7 of the support legs 39 are fastened with which the support 4 can be supported on the ground. As can be seen in FIGS. 9 through 12, the support 4 has three legs 39 distributed over its circumference which are preferably positioned at the same angular distance relative to one another. The legs 39 are of identical design as the support arms 16 so that the legs must not be described in detail here. They also have end pieces 40 with projections (noses) 41, 42 which are positioned in the suspending groove 30, 31 of the lower suspending member 7. The end pieces 40 of the legs 39 are clamped between the disks 26, 27 of the base bodies 24, 25 in the aforementioned manner. Since the suspending grooves 30, 31 are annular, the legs 39 can be continuously adjusted in the circumferential direction of the support 4. When the lower base body 25 is slightly loosened, the legs 39 can be easily moved within the suspending grooves 30,31. The bent outer edges 28, 29 prevent that the legs 39 can be accidently released from the support 4. As soon as the desired position of the legs 39 has been reached, the clamping of the lower suspending member is again effected so that the legs 39 are again clamped and can no longer be moved.

Figure 12:
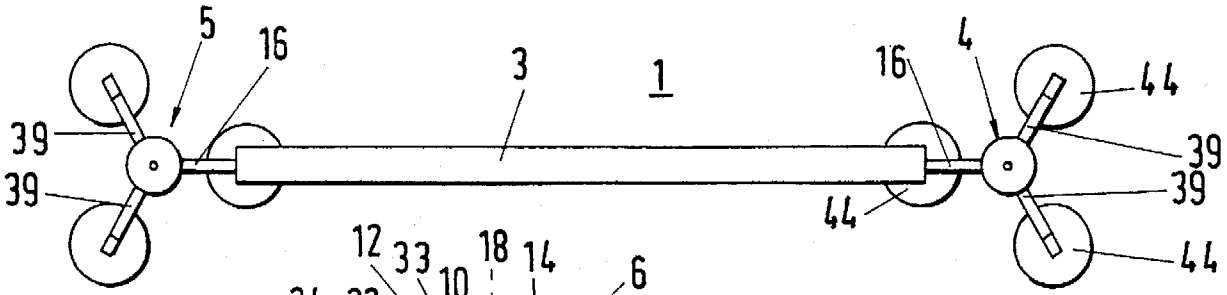
FIG. 12 show a plan view of the support structure of FIG. 10.

From FIG. 12 it can be seen that one of the legs 39 is positioned in the same plane as the support arm 16. The legs 39 can also be positioned at the support such that an aligned positioning relative to the support arm 16 is avoided.

In order to ensure a high stability of the seating system, the end pieces 43 (FIGS. 10 and 11) provided at the free end of the legs 39 are provided with support plates 44 with which the support 4 securely rests on the ground. The support plates 44, which have a circular contour (FIG. 12) in plan view, are secured with threaded bolts 45 (FIG. 13) that are threaded into the lower narrow side of the end pieces 43 of the legs 39. The support 5 is designed in the same manner as the support 4. This results in an especially inexpensive manufacture, assembly, and storage costs of the parts for the support structure. Since the support arm 16 and the legs 39 are of identical design, only one mold is required for producing these different parts.

The support arm 16 can also be designed such that its end pieces 32 and 36 are positioned in the same plane as the central portion of the support arm 16. In this case, the axis of the central portion of the support arm 16 is aligned with the axis of the horizontal bar 3. It also possible to arrange the central portion of the support arm 16 so as to extend at a slant upwardly so that the horizontal bar 3 is no longer positioned, as disclosed above, in the area below the upper disk 10 of the supports 4, 5 but in the area above these disks 10.

Figure 6:
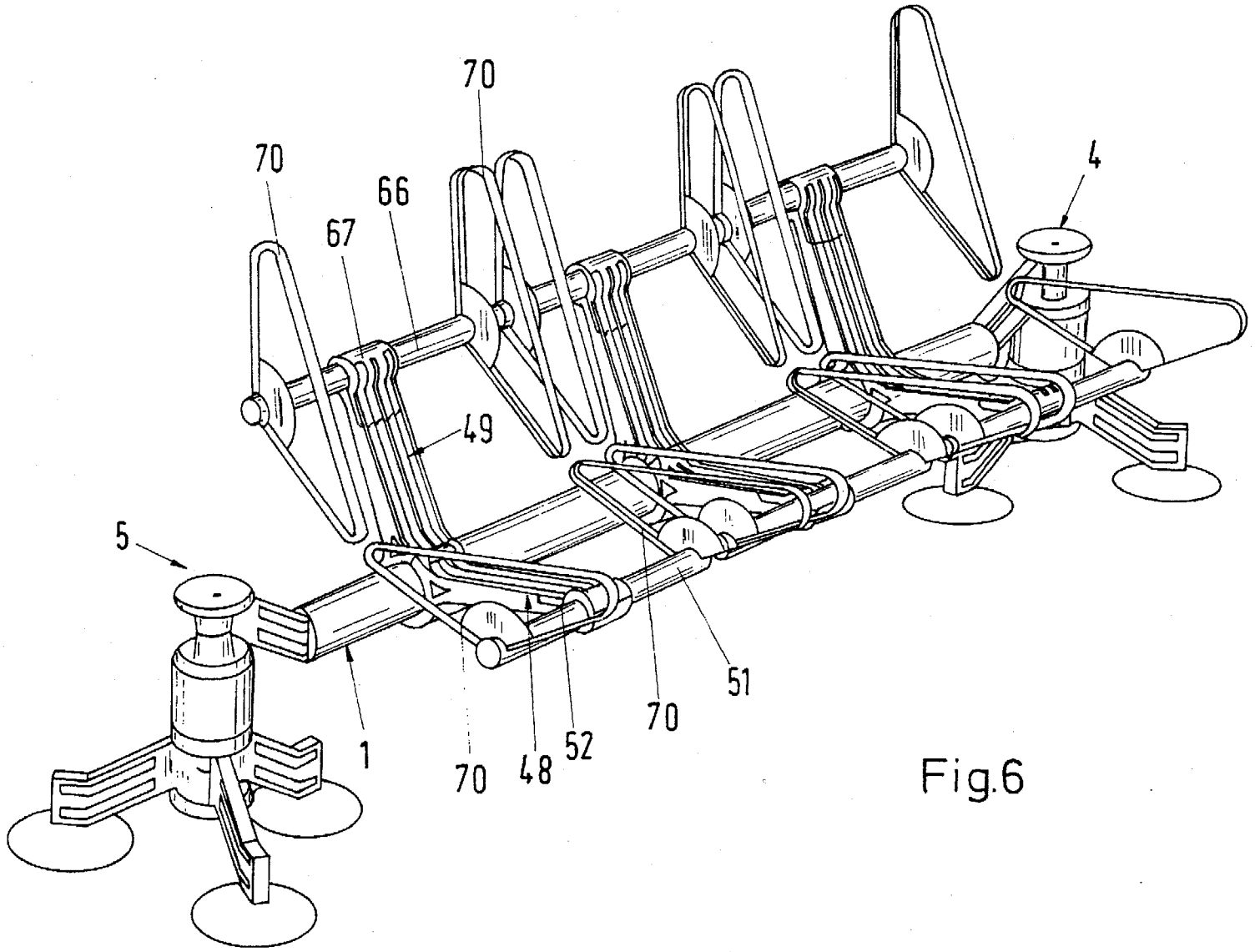
FIG. 6 shows a perspective representation of the inventive seating system without seat portion and backrest.
Figure 7:
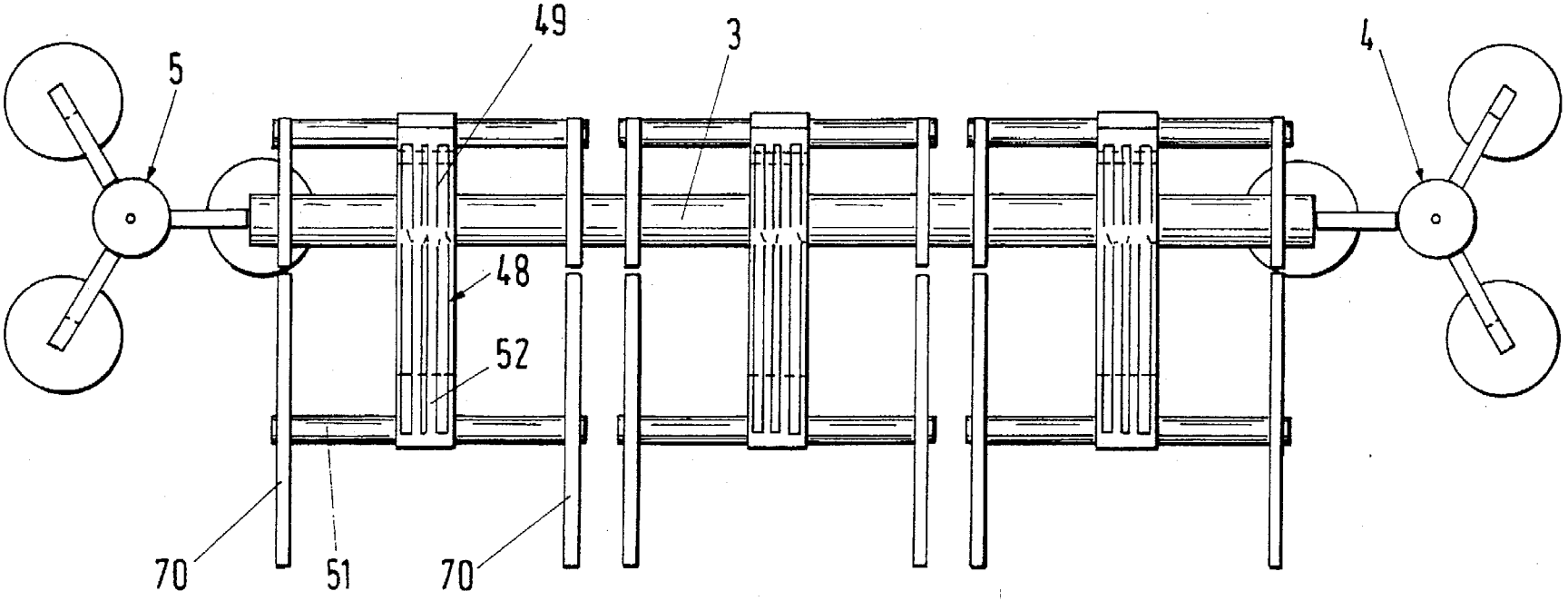
FIG. 7 shows a plan view of the seating system according to FIG. 6.

The seats 2 are detachably connected to the horizontal bar 3. In FIGS. 1 through 7 one embodiment is represented in which three seats 2 are connected to the horizontal bar 3 adjacent to one another. They have a seat portion 46 (FIG. 1) and a backrest 47. The seats 2 are designed identically. For securing the seat portion 46 and the backrest 47 to the horizontal bar 3, two support beams 48 and 49 (FIGS. 5 and 6) of identical design are provided. The support beam 48 is of a flat design and is provided at the end facing the seat with a bearing cup 50 (FIG. 5 and FIG. 8) which receives the bearing member 51 of the seat portion 46. As can be seen in FIGS. 6 and 7, the bearing member 51 extends over the entire width of the seat 2. For securing the bearing member 51 within the bearing cup 50, a clamping piece 52 with screws is fastened to the support beam 48 which together with the bearing cup 50 provides a bushing-type receiving element for the bearing member 51. For fastening the clamping piece 52, the support beam 48 is provided at its upper side with a depression 53 (FIG. 8) in which the securing part 54 of the clamping piece 52 is positioned.

The support beam 48 at its other end is provided with a further bearing cup 55 (FIGS. 3, 5 and 8) in which the horizontal bar 3 is received when the seat 2 is mounted. The bearing cup 55 is comprised of two curved bearing sections 56 and 57 whereby the section 56 is longer than the other section 57. The shorter section 57 is provided with non-represented recesses at its edges engaged by non-represented projecting eyes of the support beam 49 for the backrest 47. The eyes delimit the depressions in the bearing section 57 of the support beams 48 and 49. The eyes are provided with through openings through which the axle 58 (FIG. 5) can be introduced. Thus, the two support beams 48, 49 are pivotably connected to one another. The pivot axis (axle 58) is positioned parallel to the horizontal bar 3, respectively, to the bearing member 51 of the seat portion 46.

The support beam 49, which is of identical design as the support beam 48, also comprises a bearing cup 59 which is includes two bearing cup sections 60 and 61. The section 60 is shorter than the section 61 and is provided with projecting eyes which engage the recesses of the neighboring bearing cup section 57 of the support beam 48. The two bearing cups 55 and 59 surround the horizontal bar 3 almost completely (FIG. 8). The bearing cups 55, 59 are clamped in a suitable manner onto the horizontal bar 3.

Advantageously, the horizontal bar 3 is provided with a flattened portion 62 (FIG. 8) in order to ensure a rotationally fixed fastening of the support beams 48, 49. The bearing cups 55, 59 of the support arms 48 and 49 cooperate with this flattened portion 62. For example, the free facing ends of the bearing sections 56 and 61 can be provided with corresponding flattened portions 63 and 64 (FIG. 5) with which they rest at the flattened portion 62 of the horizontal bar 3. When the bearing cups 55, 59 are clamped onto the horizontal bar 3 with clamping screws which connect the bearing section 56 and 61 to one another, the bearing cup sections 56, 61 are pressed with their flattened portions 63, 64 in a secure manner against the flattened portion 62 of the horizontal bar 3.

The support beam 49 comprises at its other end a bearing cup 56 (FIG. 5) in which the bearing member 66 of the backrest 47 is positioned. For securing the position of the bearing member 66 within the bearing cup 65, a clamping piece 67 is provided which is of identical design as the clamping piece 52 of the support beam 48. It rests with its flattened securing part 68 in a recess 69 of the support beam 49. Similarly to the securing part 54, the securing part 68 is connected with screws to the support beam 49. The bearing cup 65 with the clamping piece 67 surrounds the bearing member 66 almost completely. In the same manner as the clamping piece 52, the clamping piece 67 is designed such that, when being screwed onto the support beam 49, it is fixedly pressed against the bearing member 66 which is thus securely held.

As can be seen in FIGS. 6 and 7 the support beams 48, 49 are arranged at half the length of the bearing member 51, 66 of the seat 2. The support beams 48, 49 have preferably the same width over their entire length.

At the two ends of the bearing member 51 triangular frame parts 70 of a U-shaped cross-section are fastened (FIGS. 5 through 8). Into the groove which is formed by the "U" a wire mesh (FIG. 3) 71 is inserted with its ends. Advantageously, the lower leg of the "U" of the frame part 70 which is below the seat surface is longer than the upper leg. Accordingly, the ends of the wire mesh 71 can be securely fastened to the longer leg of the frame part. The upper shorter leg of the frame part 70 covers the ends of the wire mesh so that there is no risk that the clothing of persons seated on the seat could be damaged. The wire mesh 71 can be comprised of metal, but also of plastic material. In the area of the tip of the triangle the legs 72 and 73 (FIG. 8) of the frame part 70 are connected with a sector-shaped flat reinforcement piece 74 with which the frame part 70 is furthermore connected to the bearing member 51, preferably by welding. The flat reinforcement piece 74 is positioned perpendicular to the axis of the bearing member 51 and in the plane of the frame part 70. The legs 72, 73 have a continuous curved transition into a leg 75 which for providing comfortable seating is slanted slightly in the rearward direction toward the horizontal bar 3.

The backrest 47 of the seat 2 also comprises a frame part 70 with wire mesh 71. The leg 75 with corresponding part of the wire mesh 71 formes the surface of the backrest at which the person sitting in the seat rests. This leg 75 with the corresponding part of the wire mesh 71 is slanted rearwardly.

In the area between the seat portion 46 and backrest 47 a continuous gap 76 (FIG. 1, 3 and 5) extends over the entire width of the seat 2. If cigarette boxes, match boxes, paper etc. are placed into the gaps 76, they will fall downwardly and thus are not caught within the seat 2.

Figure 14:
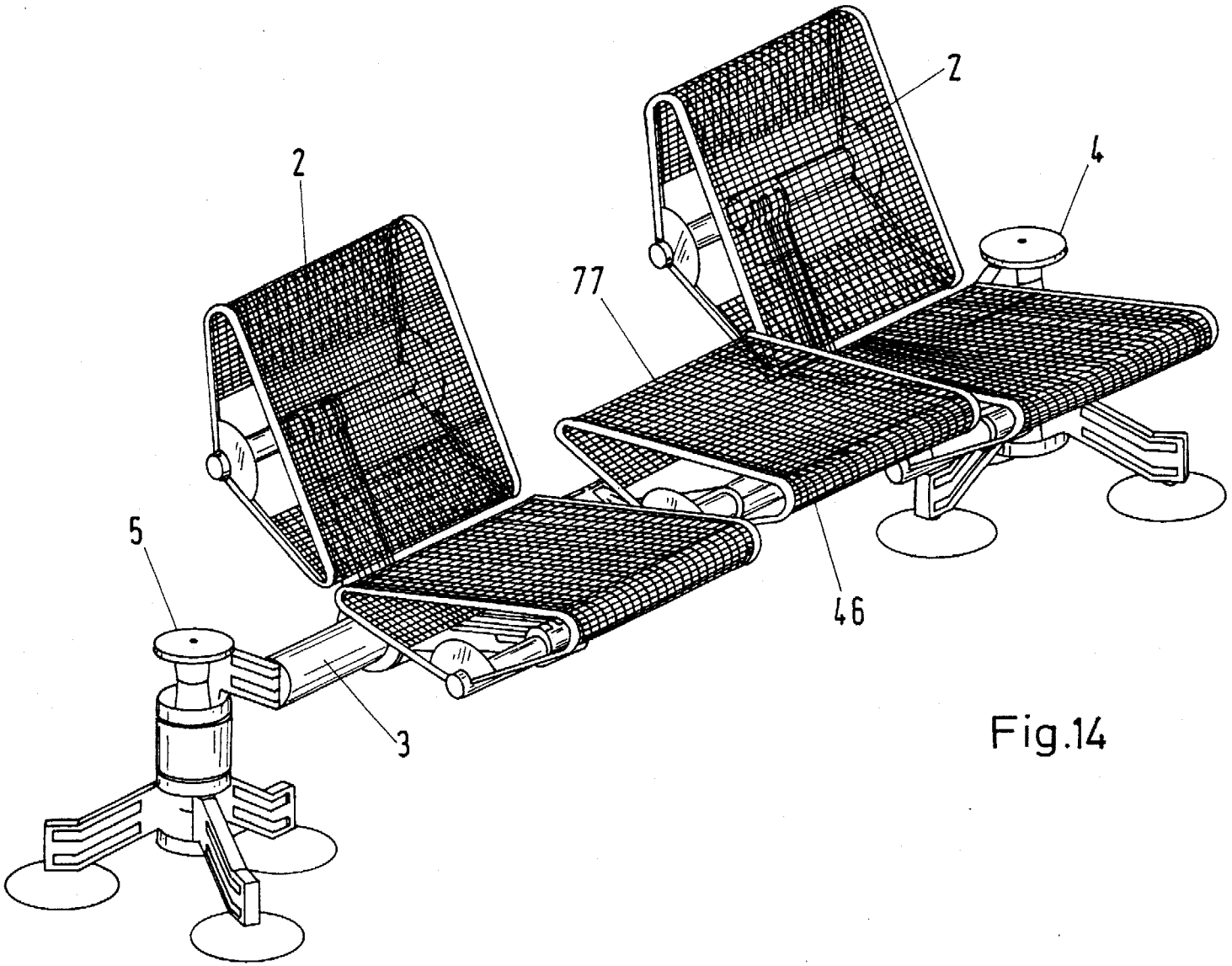
FIG. 14 shows in a perspective representation a second embodiment of the inventive seating systems.
Figure 15:
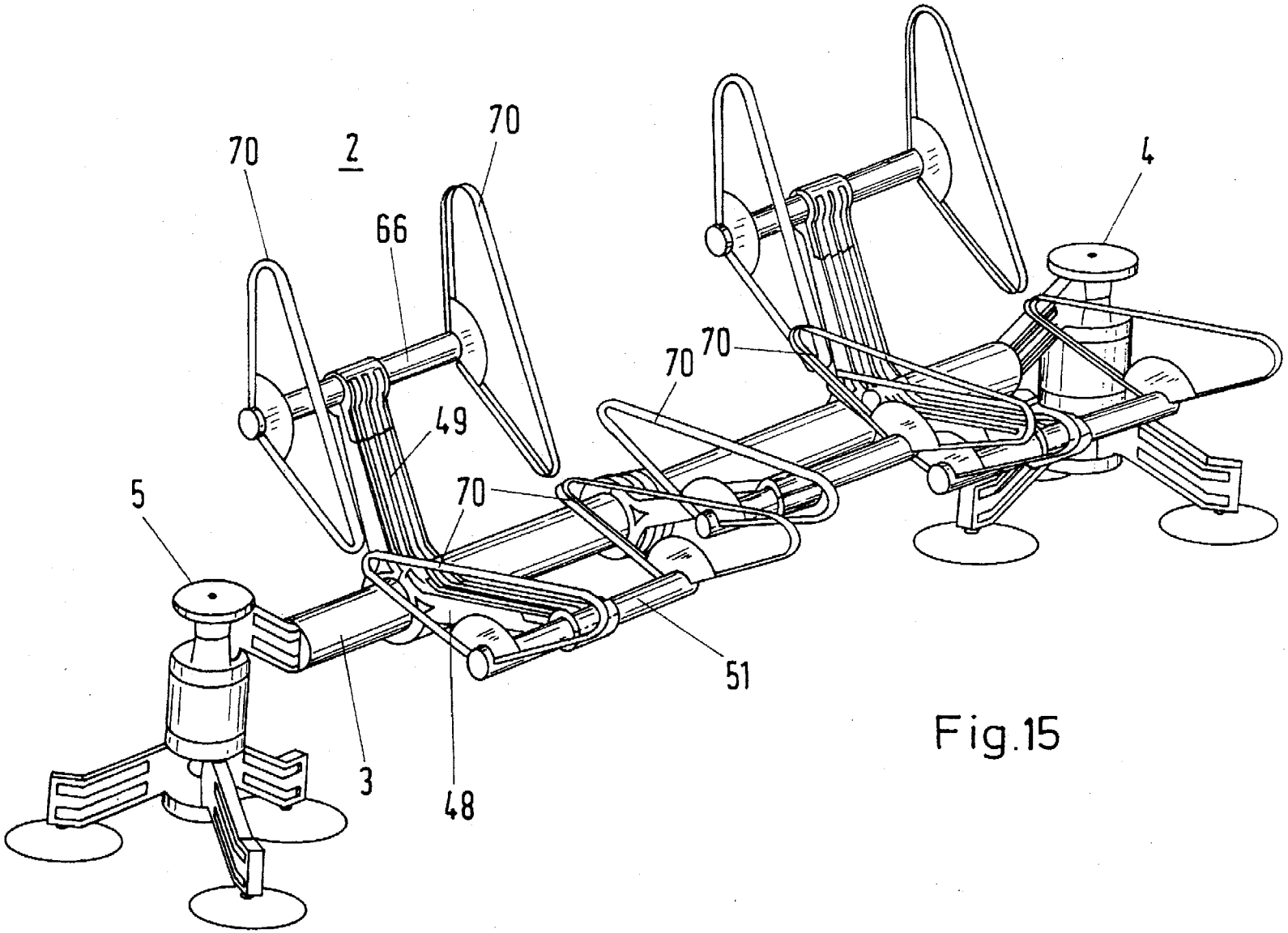
FIG. 15 shows in a perspective representation the seating system of FIG. 14 without seat portion and backrest.
Figure 16:
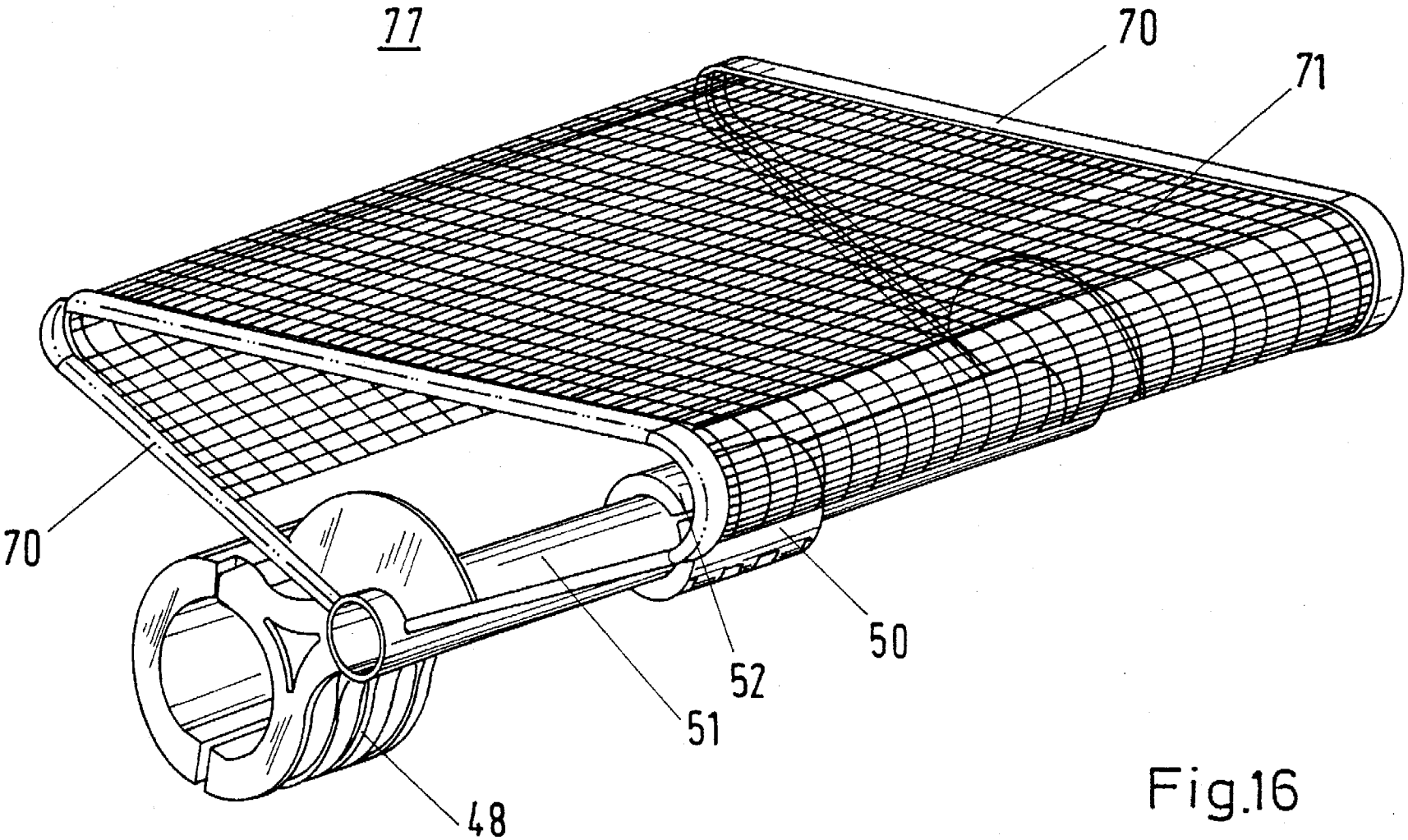
FIG. 16 shows in a perspective representation a table (shelf) of the seating system of FIG. 14.

FIGS. 14 to 16 show an embodiment of a seat in which two seats 2 are connected to the horizontal bar 3 and a table or shelf 77 is also arranged thereat. The horizontal bar 3 is suspended from the supports 4 and 5 which are identical to the discussed embodiment. The seats 2 are also of identical construction as in the previous embodiment. The table or shelf 77 is formed by a seat portion 46 which is also identical to the aforedescribed embodiments. The table 77 is arranged on the horizontal bar 3 such that the upper surface (tabletop) extends horizontally. The two seats 2, on the other hand, have seat surfaces that are slanted in the rearward direction. The seats 2 comprise frame parts 70, bearing members 51, 66 as well as the support beams 48, 49. The table 77 also comprises frame parts 70 which delimit in the lateral direction the wire mesh 71 (FIG. 16). As is shown in FIG. 16, the table 77 comprises a support beam 48 with which it is connected to the horizontal bar 3. The bearing cup 55 of the support beam 48 forms together with a part-cylindrical clamping piece a bearing bushing which surrounds the horizontal bar 3. The clamping piece is connected with clamping screws to the bearing cup 55. On the table 77, which is positioned between the two seats 2, persons seated on the seats 2 can place their bags, suitcases etc. For the table 77 the same components are used as for the seats 2 so that such a combined seating system is inexpensive and easy to manufacture and assemble.

Figure 17:
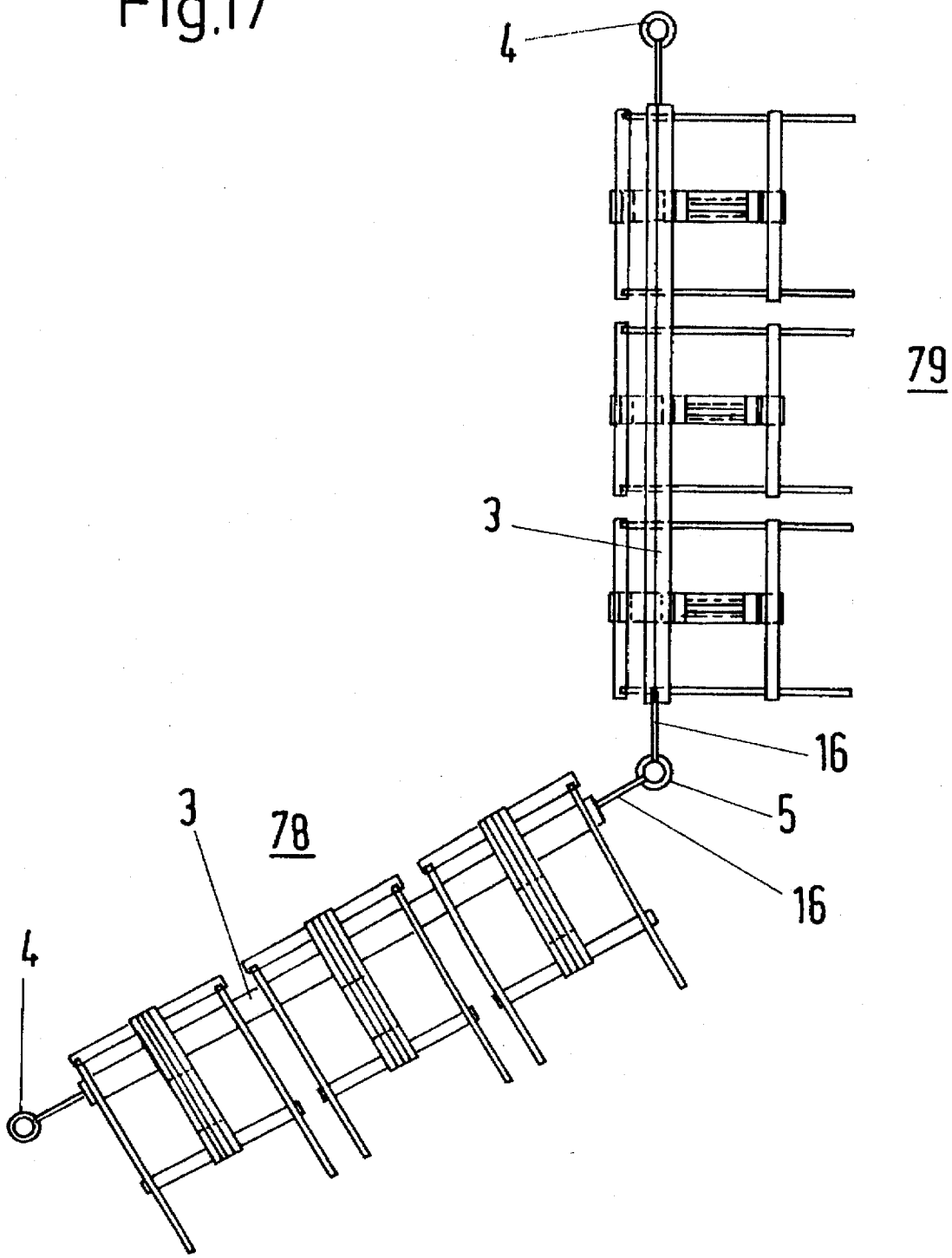
FIG. 17 shows a plan view of two angularly arranged sections of the seating system.
Figure 18:
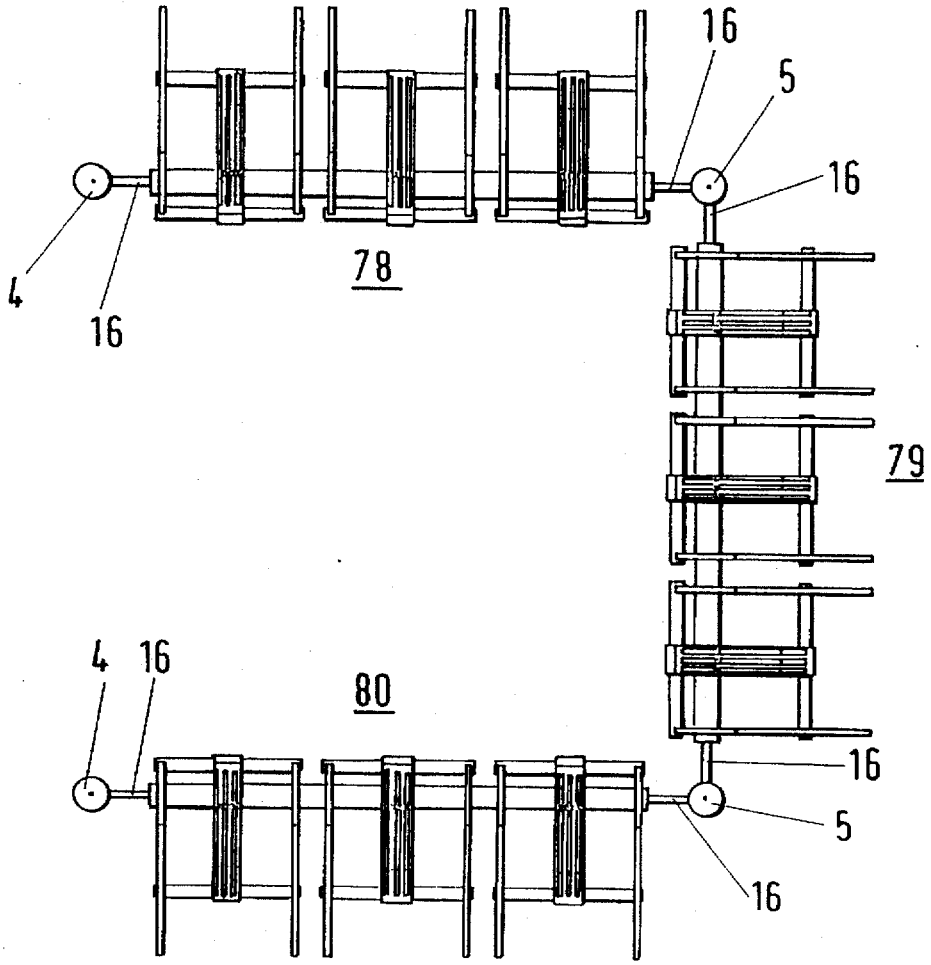
FIG. 18 shows three sections of a seating system arranged in U-shape in plan view.
Figure 19:
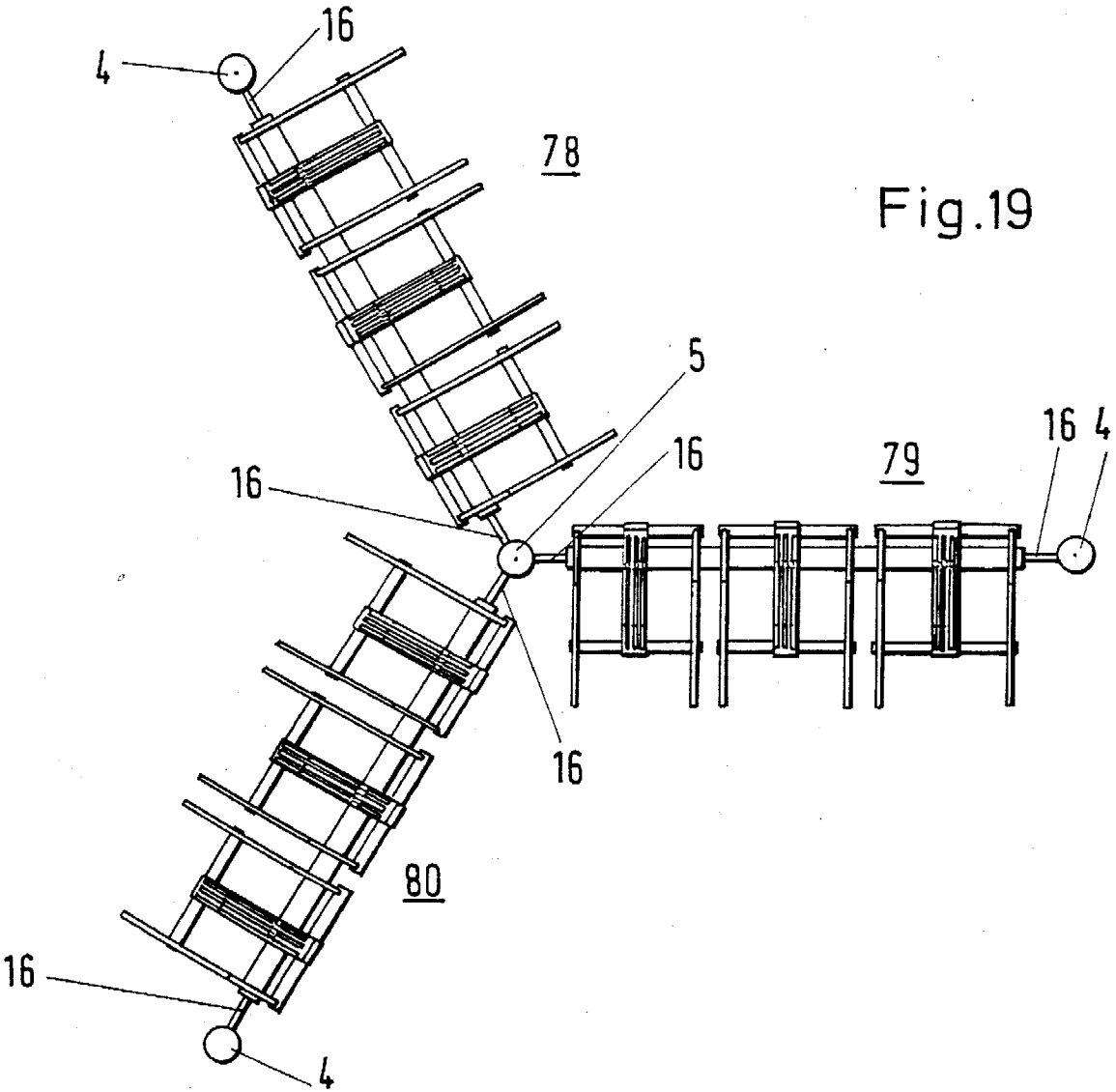
FIG. 19 shows in plan view three sections of the seating system arranged in star shape.

FIGS. 17 through 19 show different possibilities of arranging the seating system. These different arrangements are made possible by the afore-described design of the supports 4 and 5.

FIG. 17 shows an embodiment in which two seating system sections 78 and 79 are arranged at an oblique angle relative to one another. These seating systems sections can be provided with seats 2 and/or tables 77. The two seating system sections 78 and 79 must not be of identical design but can be different. They each comprise a horizontal bar 3 on which the individual units 2, 77 can be connected in the aforementioned manner. The horizontal bars 3 are suspended from the supports 4 and 5. The support 5 is a common support for both sections 78, 79. As disclosed and described in connection with FIG. 13, between the two disks 10, 11 of the base bodies 8, 9 of the upper suspending member 6 of the support 5 the support arms 16 with their end pieces 32 can be suspended. The noses 33, 34 of the end pieces 32 engage the annular suspending groove 14, 15 of the upper suspending member 6. Since these suspending grooves 14, 15 are annular, the support arms 16 of the two sections 78, 79 can be easily adjusted with respect to their relative angular position. Subsequently, the end pieces 32 of the support arms 16 are clamped between the disks 10, 11 of the upper suspending member 6 of the support 5.

The two sections, 78, 79 are arranged such that the seat surfaces of the seats are pointed in the same direction. However, it also possible to arrange the sections 78 or 79 so as to be rotated by 180° so that the persons seated on the seating system look in opposite directions.

FIG. 18 shows the possibility of arranging three sections 78 through 80 in a U-shaped arrangement. Neighboring section use a common support 5 in the same manner as disclosed above with a respective support arm 16. The free ends of the two sections 78 and 80 are suspended from a support 4. The support arm 16 suspended from the support 5, as has been explained in connection with FIG. 13, have end pieces 32 which engage with their noses 33, 34 the suspending grooves 14, 15 of the upper suspending part 6 of the support 5 and are clamped thereat. The sections 78 to 80 according to FIG. 18 can be of identical design but can also be different. The embodiment of the sections 78–80 with seats 2 and/or tables 77 can be chosen as desired. Furthermore, the sections 78 to 80 can be arranged such that the persons seated on the seats look in the same or opposite direction.

FIG. 19 shows a star-shaped arrangement of three sections 78 to 80. At their facing ends the three sections are connected with support arms 16 in the afore-disclosed manner by a common support 5. At the other end the sections are connected to supports 4. The number of seats 2 and/or tables 77 of the individual sections 78 to 80 can be selected as desired.

The supports 4 and 5 which are used in the embodiments according to FIGS. 17 to 19, may be embodied according to the disclosed embodiments of FIGS. 1 through 16 and may be provided with legs 39 which are supported via support plates 44 on the ground. Such seating systems are mobile and can be moved to other locations after assembly.

In FIGS. 17 to 19 the supports 4 and 5 are stationary. The legs 39 then do not need support plates 44. Such an embodiment will be explained in further detail with the aid of FIGS. 20 to 23. Since the supports 4 and 5 are again of identical design, only support 4 will be explained in detail.

Support 4 comprises an upper suspending member 6 with two base bodies 8 and 9 of a truncated cone shape. They are provided with disks 10 and 11 at their end faces facing away from one another which have peripheral outer edges 12 and 13 bent at a right angle. The outer edges 12, 13 delimit, as has been explained in connection with FIGS. 1 through 13, suspending grooves 14 and 15 (FIG. 21) at which in the aforementioned manner the support arm 16 (FIG. 20) with its end piece 32 is secured. Since the support 4 is anchored within the ground, a further lower suspending member is not required. For this reason, the middle section 21, in comparison to the embodiment of FIGS. 1 through 13, is elongated. Also, the ring 22 which surrounds the middle section 21 is correspondingly longer. The middle section 21 and the ring or sleeve 22 extend to the lower end of the support 4. The support 4 is embedded in concrete. With the suspending member 6, the support arm 16 is clamped between the disks 10 and 11 in the aforementioned manner.

Figure 20:
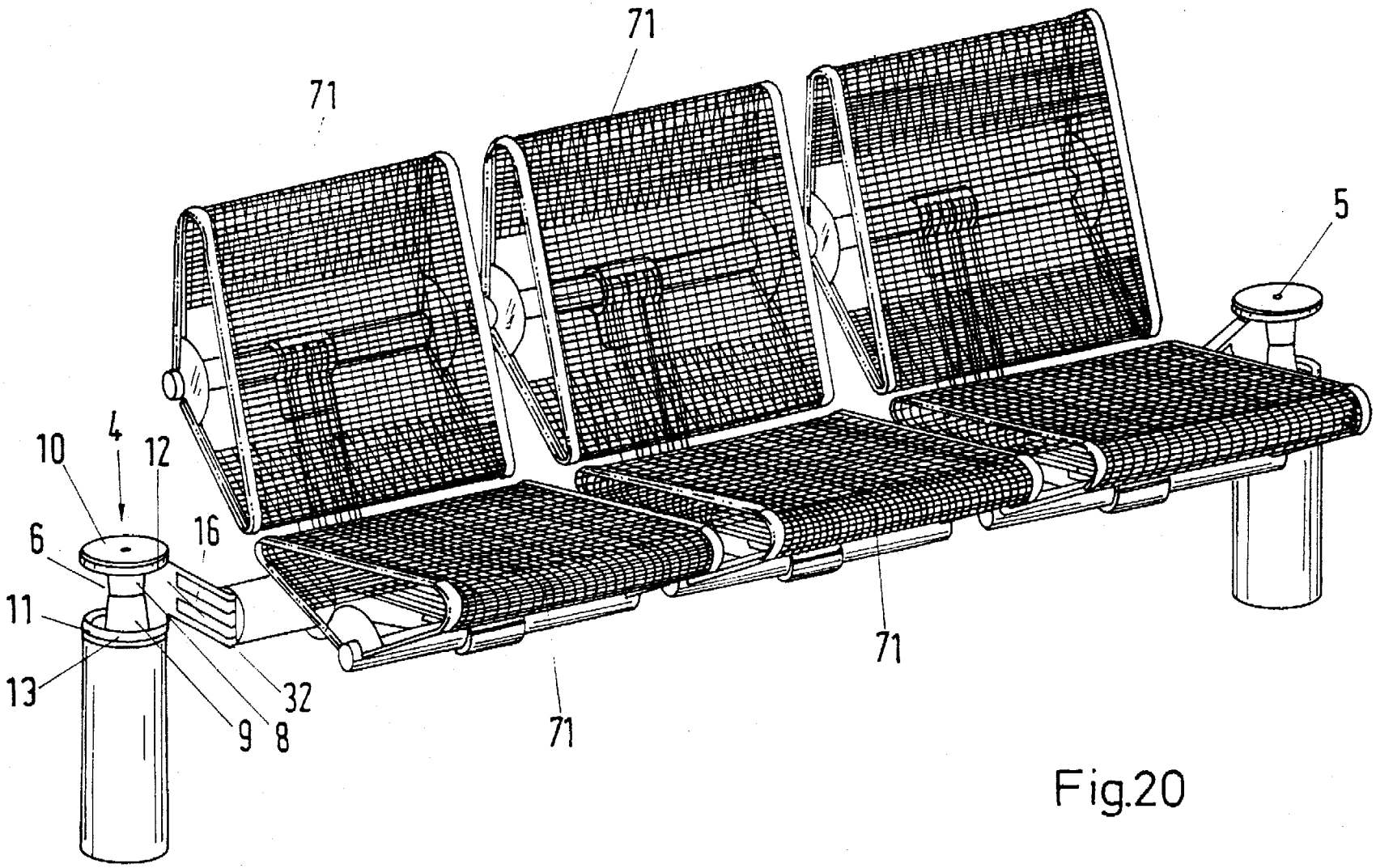
FIG. 20 shows in a perspective representation a further embodiment of the inventive seating system.
Figure 21:
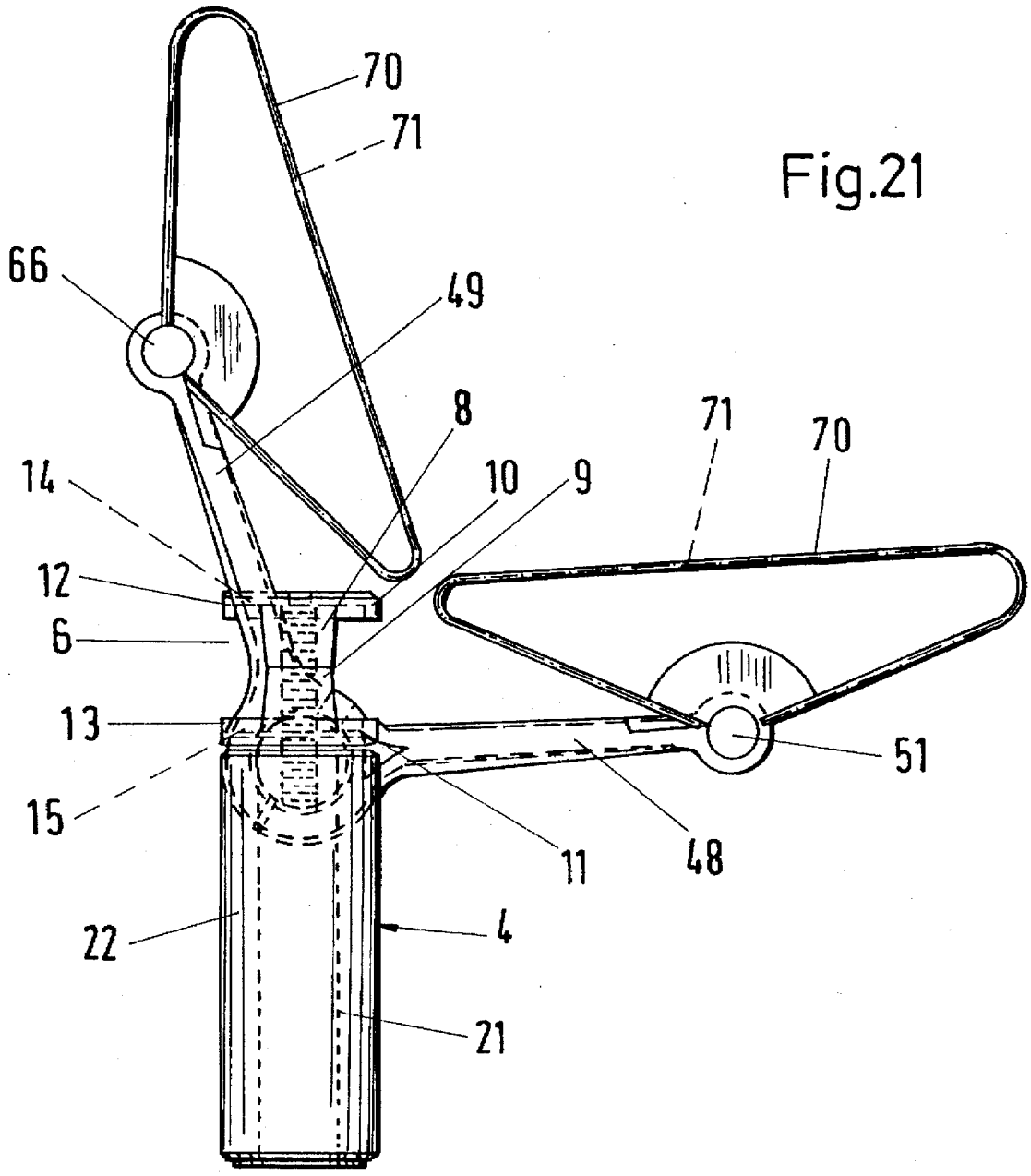
FIG. 21 shows a side view of the seating system of FIG. 20.
Figure 22:
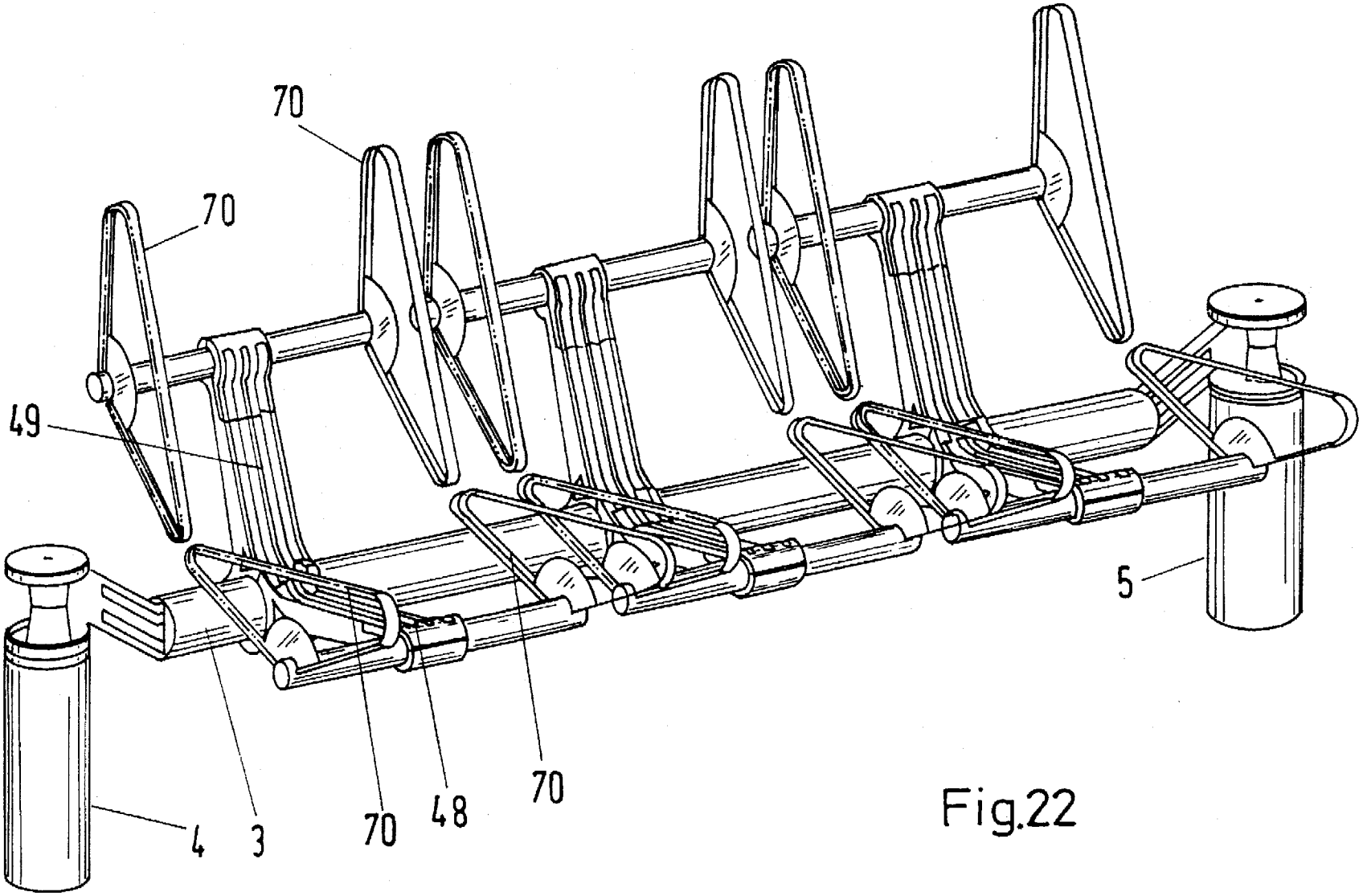
FIG. 22 shows in a perspective representation the seating system of FIG. 20 without seat portion and backrest.
Figure 23:
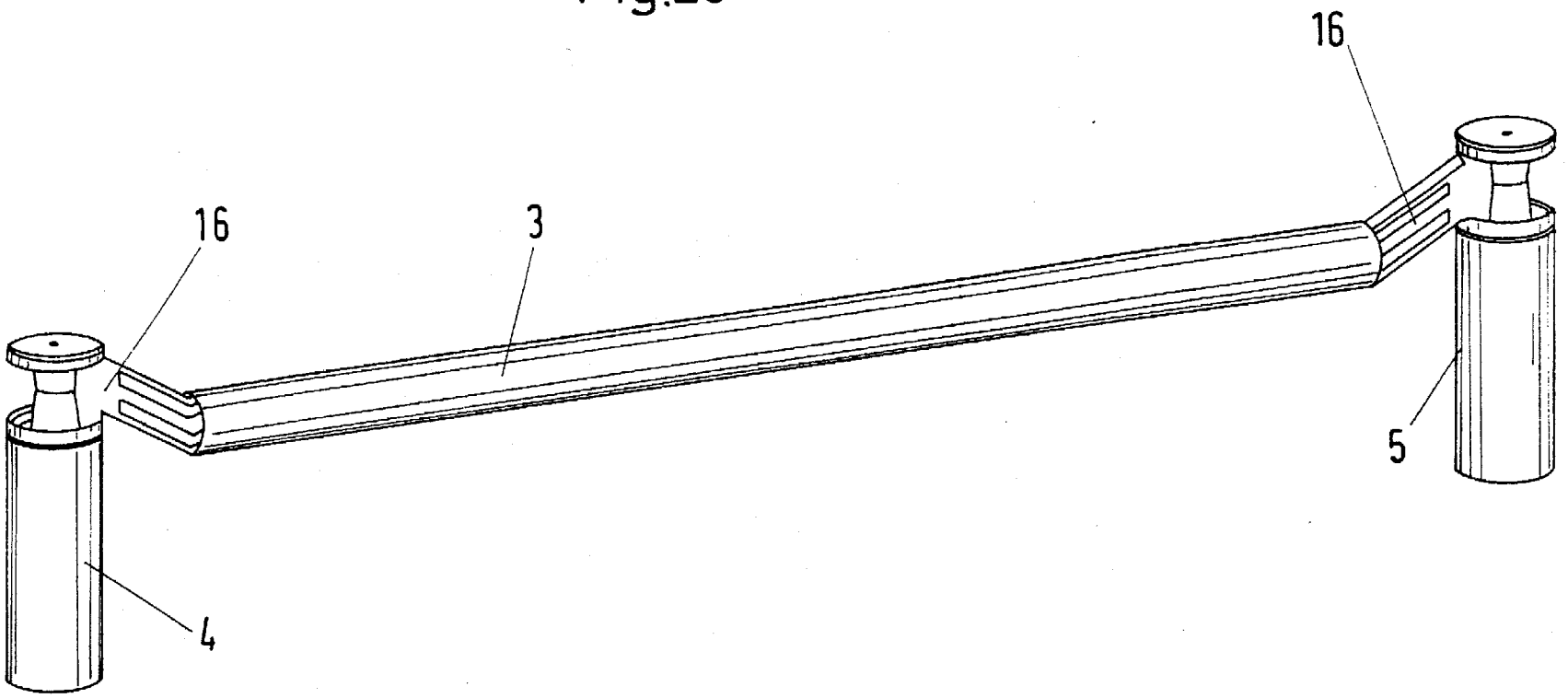
FIG. 23 shows a support structure of the seating system according to FIG. 20 in a perspective representation.

The support beams 48 and 49 for the seat portion and the backrest are connected to the horizontal bar 3 in the afore-described manner. As is shown in FIG. 22, the seat portion and the backrest have triangular frame parts 70 which receive the ends of the respective wire mesh 71 (FIG. 20 and 21). The frame parts 70 are fastened in the aforementioned manner to the bearing members 51, 66 extending parallel to one another which are secured by the support beams 48, 49.

A plurality of support arms 16 can be suspended from the suspending member 6 of each support 4, 5 so that a plurality of seating system section can be combined with one another as has been explained in connection with FIGS. 17 to 19 in an exemplary manner.

The present invention is, of course, in no way restricted to the specific disclosure of the specification and drawings, but also encompasses any modifications within the scope of the appended claims.

What I claim is:

1. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

wherein said at least one support arm is clamped to said at least one suspending member;

wherein said at least one suspending member has at least one clamping member for clamping said at least one support arm;

wherein said at least one clamping member has at least one receiving element for said at least one support arm; and wherein said at least one receiving element is a groove in said clamping member.

2. A seating system according to claim 1, wherein said groove is an annular groove.

3. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

wherein said at least one support arm is clamped to said at least one suspending member;

wherein said at least one suspending member has at least one clamping member for clamping said at least one support arm; and wherein said clamping member comprises a first base body and a first disk connected to an end face of said base body.

4. A seating system according to claim 3, wherein said first disk has a plate body and an outer edge bent at a right angle to said plate body.

5. A seating system according to claim 4, wherein said outer edge together with said base body forms said receiving element.

6. A seating system according to claim 3, wherein said suspending member has a second base body positioned opposite said first base body.

7. A seating system according to claim 6, wherein said second base body comprises a second disk connected to an end face of said second base body.

8. A seating system according to claim 7, wherein said second disk has a second plate body and an outer edge bent at a right angle to said second plate body.

9. A seating system according to claim 6, wherein said first and second base bodies are identical and positioned mirror-symmetrical to one another.

10. A seating system according to claim 9, wherein said first and second base bodies are positioned coaxially to one another.

11. A seating system according to claim 6, wherein at least one of said first and second base bodies has the shape of a truncated cone.

12. A seating system according to claim 11, wherein said at least one of said first and second base bodies tapers in a direction away from said disks connected thereto.

13. A seating system according to claim 6, wherein said first disk has a greater diameter than said first base body and wherein said second disk has a greater diameter than said second base body.

14. A seating system according to claim 1, wherein said at least one support has at least one middle section and wherein said at least one suspending member is positioned at said at least one middle section.

15. A seating system according to claim 1, wherein said at least one seat portion has a triangular cross-section.

16. A seating system according to claim 15, wherein said seat portion comprises lateral frame portions and a wire mesh, said wire mesh connected to said lateral frame portions.

17. A seating system according to claim 15, further comprising at least one backrest connected to said horizontal bar.

18. A seating system according to claim 1, wherein said seat portion is a shelf.

19. A seating system according to claim 17, wherein said backrest and said seat portion are identical.

20. A seating system according to claim 1, further comprising at least one first support beam for connecting said seat portion to said horizontal bar.

21. A seating system according to claim 20, further comprising at least one second support beam for connecting said backrest to said horizontal bar.

22. A seating system acceding to claim 21, wherein said first and second support beams are connected so as to be pivotable relative to one another.

23. A seating system according to claim 21, wherein said first and second support beams are identical.

24. A seating system according to claim 21, wherein said at least one horizontal bar comprises a means for securing said first and second support beams against rotation.

25. A seating system according to claim 24, wherein said means for securing is at least one flattened portion of said at least one horizontal bar.

26. A seating system according to claim 25, wherein said first and second support beams have a flattened portion for matching said flattened portion of said at least one horizontal bar.

27. A seating system according to claim 1, wherein said at least one support is positioned adjacent to said horizontal bar.

28. A seating system according to claim 1, comprising at least, two of said horizontal bars, wherein one of said at least one supports is a central support for said at least two horizontal bars.

29. A seating system according to claim 28, wherein each one of said horizontal bars is connected with one of said support arms to said at least one suspending member of said central support.

30. A seating system according to claim 1, wherein said at least one horizontal bar has a round cross-section.

31. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

wherein said at least one support has at least one middle section and wherein said at least one suspending member is positioned at said at least one middle section; and wherein said at least one support further comprises a ring surrounding said middle section.

32. A seating system according to claim 31, wherein said at least one support arm is clamped to said at least one suspending member.

33. A seating system according to claim 32, wherein said at least one suspending member has at least one clamping member for clamping said at least one support arm.

34. A seating system according to claim 33, wherein said at least one clamping member has at least one receiving element for said at least one support arm.

35. A seating system according to claim 34, wherein said at least on receiving element is a groove in said clamping member.

36. A seating system according to claim 31, wherein said ring has a smaller axial length than said middle section.

37. A seating system according to claim 31, wherein said middle section is cylindrical.

38. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

wherein said at least one support has at least one middle section and wherein said at least one suspending member is positioned at said at least one middle section; and wherein each one of said supports comprises two said suspending members connected to opposite end faces of said middle section.

39. A seating system according to claim 38, wherein said at least one support comprises at least one leg connected to a lower one of said suspending members.

40. A seating system according to claim 39, wherein said at least one leg and said at least one support arm are identical.

41. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

wherein said at least one support arm is clamped to said at least one suspending member;

wherein said at least one suspending member has at least one clamping member for clamping said at least one support arm;

wherein said at least one clamping member has at least one receiving element for said at least one support arm; and wherein said at least one support arm comprises a first end piece with projections and wherein said projections engage said receiving element.

42. A seating system according to claim 41, wherein said first end piece has an end face facing said base body, wherein said end face matches the contour of said base body and rests flush at said base body.

43. A seating system according to claim 41, wherein said support arm is positioned on edge.

44. A seating system according to claim 41, wherein said at least one support arm comprises a second end piece for engaging said horizontal bar.

45. A seating system according to claim 44, wherein said second end piece is clamped at said horizontal bar.

46. A seating system according to claim 44, wherein said at least one support arm has a center piece extending angularly to said first and said second end pieces.

47. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

wherein said at least one seat portion has a triangular cross-section;

wherein said seat portion comprises lateral frame portions and a wire mesh, said wire mesh connected to said lateral frame portions; and wherein each one of said frame portions in cross-section is U-shaped with a first and a second leg.

48. A seating system according to claim 47, wherein said first leg to which said wire mesh is connected is longer than said second leg.

49. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support;

said at least one support arm connecting said horizontal bar to said at least one support;

at least one first support beam for connecting said seat portion to said horizontal bar;

wherein said seat portion has a bearing member and wherein said at least one support beam has a first end with a first bearing cup for receiving said bearing member.

50. A seating system according to claim 49, further comprising a clamping piece connected to said at least one support beam for fastening said bearing member within said bearing cup.

51. A seating system according to claim 4, wherein said at least one first support beam has a second end with a second bearing cup for attaching said at least one support beam to said horizontal bar.

52. A seating system comprising:

at least one support;

at least one horizontal bar supported by said at least one support;

at least one seat portion connected to said horizontal bar;

said at least one support comprising at least one suspending member;

at least one support arm for each one of said at least one supports;

said at least one support arm hung from said at least one support:

said at least one support arm connecting said horizontal bar to said at least one support;

at least one first support beam for connecting said seat portion to said horizontal bar;

at least one second support beam for connecting said backrest to said horizontal bar;

wherein said first and said second support beams each have an end with a bearing cup for clamping said first and second support beams onto said horizontal bar.

* * * * *